US005712832A

United States Patent [19]

Sakamoto

[11] Patent Number: 5,712,832

[45] Date of Patent: Jan. 27, 1998

[54] ELECTRONIC CLOCK AND TIME SETTING METHOD

[75] Inventor: Yumi Sakamoto, Tatsuno-machi, Japan

[73] Assignee: Seiko Epson Corporation, Tokyo, Japan

[21] Appl. No.: 468,156

[22] Filed: Jun. 6, 1995

[30] Foreign Application Priority Data

Jun. 22, 1994 [JP] Japan ..... 6-140469

[51] Int. Cl.[6] ..... G04C 9/00

[52] U.S. Cl. ..... 368/187

[58] Field of Search ..... 368/185–187, 368/72–74

[56] References Cited

U.S. PATENT DOCUMENTS

| | | | |
|---|---|---|---|
| 3,988,597 | 10/1976 | Yamaguchi | 368/188 |
| 4,030,283 | 6/1977 | Sauthier et al. | 368/188 |
| 4,365,898 | 12/1982 | Wakai | 368/187 |
| 4,415,276 | 11/1983 | Ikehata et al. | 368/187 |
| 4,431,314 | 2/1984 | Portmann | 368/188 |

*Primary Examiner*—Bernard Roskoski

*Attorney, Agent, or Firm*—Stroock & Stroock & Lavan LLP

[57] ABSTRACT

An electronic clock for indicating a time including a source oscillator having a predetermined frequency, a frequency divider circuit for dividing down the frequency of the source oscillator, an input device for generating a continuous input signal when actuated, an input control circuit for detecting the input signal from the input device, an input time counting circuit for counting a period of time from the clock signal during which the input control circuit detects a continuous input signal from the input device, an input time detecting circuit for detecting when the period of time counted by the input time counting circuit equals at least one predetermined value, and a setting increment/decrement control circuit to establish successive predetermined periods of time determined by at least one predetermined value, the rate at which the set time is incremented or decremented is varied in each predetermined period of time by changing a value of a unit of time to be added to or subtracted from the set time.

22 Claims, 11 Drawing Sheets

START
1001
IS ADDITION SWITCH TURNED ON ?
N
Y
1002
RISING EDGE ?
Y
N
1003
SELECT ONE-MINUTE PLACE
1006
1 Hz ?
N
Y
1007
K=K+1
1008
K<2 ?
Y
N
1004
+1 MINUTE
1005
K=0
1009
2≦K<6 ?
Y
N
1010
SELECT ONE-MINUTE PLACE
1012
6≦K<10 ?
Y
N
1013
SELECT TENS-MINUTE PLACE
1015
10≦K<14 ?
Y
N
+1 MINUTE
1011
1018
SELECT TEN-HOURS PLACE
1016
SELECT ONE-HOUR PLACE
1014
1019
+10 HOURS
+1 HOUR
+10 MINUTE
1020
DISPLAY
1017
END

ELECTRONIC CLOCK AND TIME SETTING METHOD

BACKGROUND OF THE INVENTION

The present invention generally relates to an electronic clock and to a method for setting numerical values of a time of day, an alarm time and the like in an electronic clock, and more particularly, to an improved electronic clock which includes an improved time setting circuit which uses an improved fast forward setting method.

In conventional electronic clocks, a widely used method by which operators set a time therein is called an "even-rate fast-forward setting method" wherein a unit of time is continuously added to, or subtracted from, a currently set time at an even or uniform rate (namely, a fast forward operation is performed) during an input operation caused by closing a setting switch after the input operation is determined to have been continuing for one or two seconds. Moreover, an improved conventional method termed "a variable-rate fast-forward" setting method has been used whereby the frequency of adding (or subtracting) a unit of time is changed according to the duration of the switch input operation. In the case of this "variable-rate fast-forward method", a clock rate or speed, which is a control frequency of a time control circuit (for instance, a microcomputer) is successively changed to, for example, 8, 16, 32 and 64 Hz in this order for performing an addition (or subtraction) of a unit time. In accordance with this improved conventional method, as the duration of the switch input operation becomes longer, an amount of change in time, which is caused by an addition (or a subtraction) of a unit of time, becomes larger. That is the rate at which the time is adjusted increases. Therefore, this method is advantageous to reduce the amount of time it takes to set a desired target time that is far away from the currently set time.

However, the aforementioned conventional electronic clocks and methods of setting them have the following problems. First, in the case of employing the "even-rate fast-forward setting" method, if a fast-forward rate is set as relatively low, a fast forward is performed at a rate at which a unit time is added every period corresponding to the control frequency of 8 Hz, and if a target time is far away from a currently set time, it takes a relatively long time to set the target time. However, if the fast-forward rate is set as relatively high, the target time is immediately exceeded and it is difficult to set the target time.

Further, in the cases of "variable-rate fast-forward" methods as exemplified by the method of the unit-time adding/subtracting clock variable type, addition or subtraction processing of a unit time is periodically performed by the time control circuit (such as a microcomputer) during the time when the fast forward rate is low. Thus the time is set at a target fast-forward rate. However, when the clock speed is, for example, 32 or 64 Hz, a period required to perform the addition or subtraction processing becomes short. It is, therefore, feared that the processing can not be completed within an operation cycle corresponding to the clock rate of 32 or 64 Hz. Consequently, there is the possibility that periodic additions or subtractions cannot be reliably performed, and particularly, additions or subtractions cannot be stably performed at a uniform rate thus giving an operator (i.e., user) a feeling of incongruity about an operation. Moreover, the "variable-rate fast-forward" methods have a problem in that an operation may be stopped for a moment in the middle of a fast forward operation and this causes an operator to feel that an operation has become disabled in mid-operation. This problem is not confined to a mere sensory illusion. The instability in operation speed at which an addition or a subtraction is performed leads to difficulty in setting the time. That is, a user finds that the unstableness and unevenness of the operation speed makes it difficult to predict when the user should release or open the switch during the fast forward operation, and in particular, when the user should discontinue the fast forward to facilitate the setting of the target time.

To further increase the clock frequency (or source frequency) of the system clock, it is known to stably perform additions or subtractions to reduce a one-instruction execution time (thus the clock rate of a system clock) of a microcomputer. However, this results in an increase in current consumption and also results in a rise of the lower limit of the operating voltage of the microcomputer. Consequently, the battery life is shortened. Moreover, in the case of an ordinary clock, a source oscillator having an oscillating (or source) frequency of 32.768 kHz becomes necessary for measuring time intervals. Thus a second oscillator having an oscillating frequency different from 32.768 kHz may also be necessary. Consequently, this conventional method results in an increase in cost and number of components and the electronic clock in accordance with the prior art is larger in size than desired.

Moreover, the current consumption of the microcomputer is a result of both a hardware portion thereof and another section for performing software operations. Further, the addition or subtraction processing requires a high frequency operation. Every period corresponds to the clock frequency of 32 or 64 Hz. This also results in increase in current consumption and decrease in battery life. Furthermore, in the situation where there is no other processing than the addition or subtraction processing to be performed every period corresponding to the frequency of 32 or 64 Hz, the microcomputer, which should be in a stand-by state or a stopped state, is activated. This also leads to the increase in current consumption and to the decrease in battery life.

Accordingly, an electronic clock in which a time can be set securely and quickly at a stable fast forward rate and an improved method for setting the time in the clock that also overcomes the aforementioned problems is desired.

SUMMARY OF THE INVENTION

In accordance with the present invention, an electronic clock for indicating a time is provided. The electronic clock includes a source oscillator for generating a clock signal having a predetermined frequency, a frequency divider circuit operatively coupled to said source oscillator for dividing down the frequency of the clock signal, an input device for generating an input signal, an input control circuit operatively coupled to said input device for detecting the input signal from the input device and setting a time in response thereto, an input time counting circuit operatively coupled to the input control circuit for counting a period of time during which the input control circuit detects the input signal from the input device, an input time detecting circuit operatively coupled to the input time counting circuit for detecting when the period of time counted by the input time counting circuit equals a predetermined value and a setting increment/decrement control circuit operatively coupled to the input time detecting circuit for establishing predetermined periods of time in accordance with the output signals of the frequency divider circuit and the input time detecting circuit and varying the rate at which said set time is incremented or decremented by changing a value of a unit of time added to or subtracted from the set time each of the predetermined periods of time.

A configuration of the electronic clock includes a frequency divider circuit for "dividing down" (namely, outputting a signal having a frequency of an integral submultiple of) the frequency of a source oscillator such as a crystal oscillator, an input control circuit for detecting a switch input (signal) inputted by operating a switch for setting a time, an input time counting circuit for counting or measuring a period of time during which the input control circuit detects a continuous input signal sent from the same switch by using output clock signals of the frequency divider circuit an input time detecting circuit for detecting the fact that a value of the period measured by the input time counting circuit reaches a predetermined value, and a setting increment/decrement control circuit for varying a setting increment or decrement of a value set in units of a unit time to be added or subtracted every predetermined period, which is formed using an output clock signal of the frequency divider circuit according to an output of the input time detecting circuit.

In a preferred embodiment, the input time counting circuit counts the clock signal having a frequency of 1 Hz outputted from the frequency divider circuit. The setting increment/decrement control circuit operates in response to each clock signal having a frequency of 4, 8 or 16 Hz, which is generated by the frequency divider circuit. The increment and decrement are changed to $\pm 2^n$ ($\pm 2, \pm 4, \pm 8, \ldots$) units of time.

In an alternative embodiment, the electronic clock of the present invention includes a frequency divider circuit, an input control circuit, an input time counting circuit, an input time detecting circuit, and a setting-place selecting circuit for selecting a setting place according to an output of the input time detecting circuit. The setting place, or time setting place as described below, corresponds to the place or digit that is being changed. A non-selected place display control circuit is also provided for displaying given numerical values, symbols, characters and patterns provided in the electronic clock which correspond to the places or digits other than a numerical-value place selected by the setting-place selecting circuit.

The non-selected setting-place display control circuit operates at a speed faster than the operating speed of addition/subtraction circuit and display control circuit which are caused by the setting-place selecting circuit to operate.

Accordingly, it is an object of this invention to provide an improved electronic clock.

It is another object of the present invention is to realize an electronic clock in which a time can be set with favorable operability.

A further object of the present invention is to realize an electronic clock which can prevent an increase in unnecessary current consumption and does not impose an excessive load on software used in a time control circuit such as a microcomputer.

Still another object of the present invention is to provide a method for setting a time in an electronic clock, by which the frequency of a clock signal used for performing additions or subtractions in a time control circuit such as a microcomputer is held constant and a unit time to be added or subtracted is changed according to the duration of an operation of a setting switch for setting a time, and in particular, by which addition or subtraction processing for achieving a fast forward operation is performed at regular time intervals (i.e., the timing or regulation of this processing is effected in such a manner that the operation speed is constant) and an amount of time (in units of a unit time) to be added or subtracted is changed according to the duration of an operation of the setting switch.

Still other objects and advantages of the invention will in part be obvious and will in part be apparent from the specification and drawings.

The invention accordingly comprises the several steps and the relation of one or more of such steps with respect to each of the others, and the apparatus embodying features of construction, combination of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENT

In the instant application, the phrase "a time" is used not only to designate hours, minutes and seconds but also to designate information regarding "time" in a broad sense, which may involve the date and day of the week.

Figure 2:
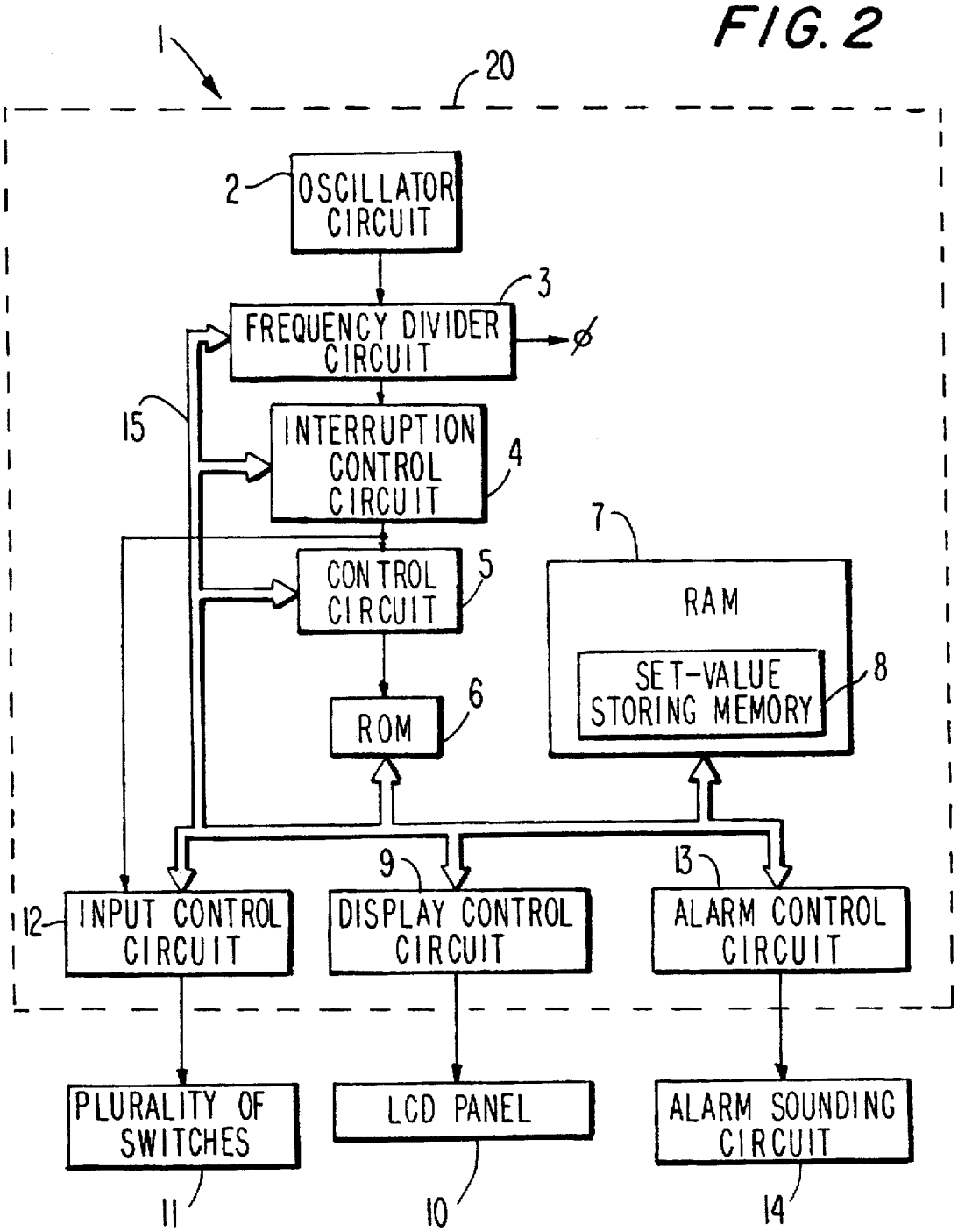
FIG. 2 is a diagram of the electronic clock constructed in accordance with the present invention.

Reference is first made to FIG. 2 wherein a block diagram of the entire electronic clock to which the present invention is applied will be described in general. An electronic clock, generally indicated at 1, includes a microcomputer 20, a plurality of switches 11 providing inputs to microcomputer 20, a liquid crystal display (LCD) panel 10 and an alarm sounding circuit 13 controlled by microcomputer 20.

Microcomputer 20 is operative to control entire electronic clock 1. An oscillator circuit 2 employing a crystal oscillator as a source oscillator is built into microcomputer 20. The frequency of an output of oscillator circuit 2 is "divided down" by a frequency divider circuit 3. Moreover, an output signal of frequency divider circuit 3 is used as a system clock signal $\phi$. The oscillating frequency of the source oscillator is typically 32.768 kHz. A divide-by-2 process is repeatedly performed until a signal having a frequency of 1 Hz is finally obtained from the signal having the oscillating frequency of the source oscillator. Further, frequency divider circuit 3 can provide a plurality of outputs which, having a plurality of frequencies, can be used as various clock signals. An output clock signal of frequency divider circuit 3 is input to an interruption control circuit 4 and is also used as an interruption timing signal. This interruption control circuit 4 is used for controlling interruptions caused by a microcomputer internal signal and an external signal (not shown) and is connected to both an input control circuit 12 and a control circuit 5. Control circuit 5 serves as a primary portion for controlling various operations such as those of stopping and activating microcomputer 20 under the control of programs stored in a read only memory (ROM) 6. Moreover, it is control circuit 5 that controls a time-setting operation which is particular to the present invention.

An internal BUS 15 interconnects control circuit 5, ROM 6 for storing programs to control operations of the electronic clock, a random access memory (RAM) 7 for storing various data needed in the operations of the electronic clock, a display control circuit 9 for controlling a display concerning the electronic clock, an input control circuit 12 for monitoring the state of plurality of switches 11 and an alarm control circuit 13 for controlling an sounding operation of an alarm sounding circuit 14.

Moreover, frequency divider circuit 3 is also connected to the internal bus 15 so information representing the state of frequency divider circuit 3 can be read by executing a program. Furthermore, interruption control circuit 4 is also connected to internal bus 15 so the establishment of interruption conditions, as well as the reading of interruption source, can be achieved by executing programs. Additionally, a set-value storing memory 8 for storing a set value of time is provided in a part of RAM 7. This set-value storing memory 8 is not always provided in RAM 7, because an independent memory or register may also be used as set-value storing memory 8. Further, set-value storing memory 8 may be provided in a nonvolatile RAM.

Alarm sounding circuit 14 can be, but is not, limited to a piezo-electric buzzer. The alarm sounding circuit can be any circuit that provides a vibration at a vibration frequency so as to notify an operator (i.e., user) of a warning. Such examples of alternative alarm sounding circuits are acoustic loudspeakers, bells, a tuning fork and a vibrator.

Further, switches 11 are provided in the body (not shown) of electronic clock 1 and can be push-button switches which can be operated by the operator. Moreover, switches 11 can include an addition switch for adding an increment to a set time and a subtraction switch for subtracting a decrement from the set time. In addition to these switches, diverse switches may be provided in electronic clock 1 if so desired. It is also to be understood that while push-button switches are typically employed, the switches are not limited thereto. For example, a slide switch or a touch switch may be employed. Furthermore, switches 11 may be provided in a portion of electronic clock 1 other than in the body thereof. For example, a remote control switch, or an input device, such as a keyboard, pen or mouse of an electronic device, such as a computer, connected to electronic clock 1, may be used instead of or in addition to switches 11.

Figure 1:
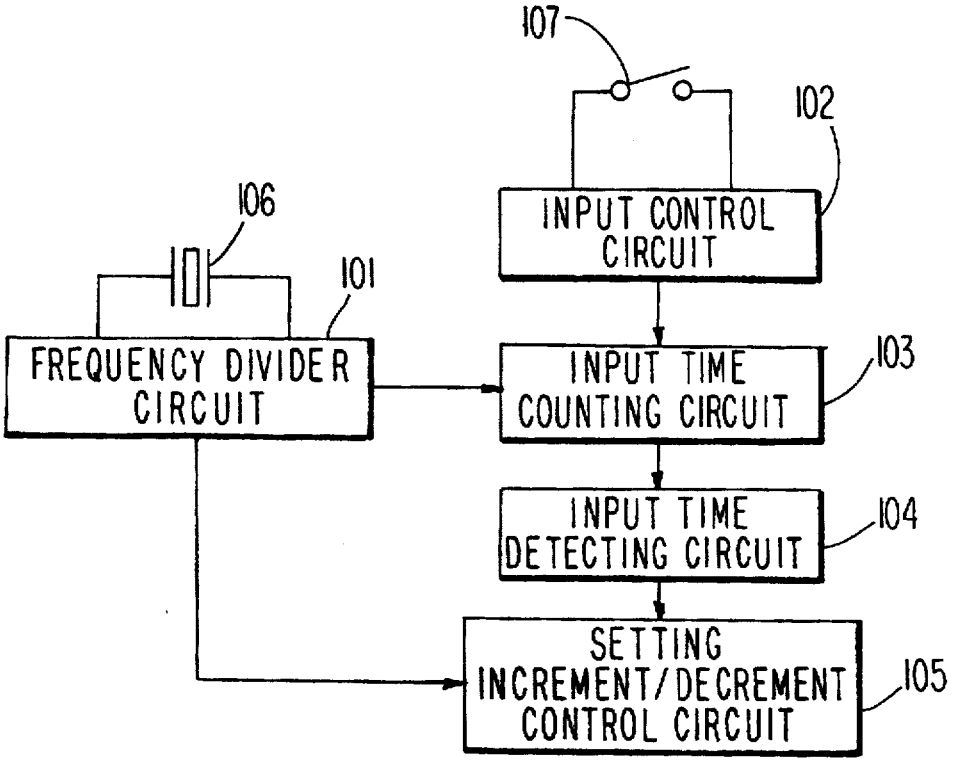
FIG. 1 is a block diagram of an electronic clock constructed in accordance with a first embodiment of the present invention.

Reference is first made to FIG. 1 which illustrates an electronic clock of the present invention constructed in accordance with the first embodiment of the invention in a block diagram. The electronic clock includes a frequency divider circuit 101 for "dividing down" (i.e., outputting a signal having a frequency of an integral submultiple of) the frequency of a source oscillator 106 such as a crystal oscillator, an input control circuit 102 for detecting a switch input (signal) inputted by operating a switch 107 for setting a time, an input time counting circuit 103 for counting or measuring a period of time during which the input control circuit 102 detects a continuous input signal sent from the same switch by using output clock signals of the frequency divider circuit 101, an input time detecting circuit 104 for detecting the fact that a value of the period measured by the input time counting circuit 103 reaches a predetermined value, and a setting increment/decrement control circuit 105 for varying a setting increment or decrement of a value set in units of a unit time to be added or subtracted every predetermined period, which is formed using an output clock signal of the frequency divider circuit 101, according to an output of the input time detecting circuit 104, as illustrated in FIG. 1.

This is an electronic clock of the present invention and thus requires a clock signal (namely, a one-second signal) having a frequency of 1 Hz to count or measure a time interval. Further, it is preferable that a source oscillator 106 has a predetermined oscillating frequency which is "divided down" by frequency divider 101 into multiple levels or stages in such a way that the ratio between the adjoining levels is (½). This simplifies the configuration of frequency divider-circuit 101. Therefore, the frequency divider circuit 101 can easily generate a clock signal having a frequency of $2^n$ Hz (n is an integer equal to or greater than 0). Moreover, the use of a clock signal having a frequency of $2^n$ Hz is advantageous because both input time counting circuit 103 and setting increment/decrement control circuit 105 use output clock signals of the frequency divider circuit 101.

Thus, it is preferable that input time detecting circuit 103 counts the clock signal having a frequency of 1 Hz outputted from frequency divider circuit 101. In this case, the reasons why the clock signal having a frequency of 1 Hz is used to detect a continuous input time, during which a continuous input signal sent from the switch is detected, are that such clock signals provide the timing which is best fitted to an operator's feeling during an operation, that an appropriate load to be imposed on the software for detecting the time is realized, that namely, an operating time, in which an operator operates the switch for setting a time, is calculated generally in second units, and that in view of this operating time, the software for detecting the input time has only to run in a time to be calculated in seconds and thus it is not so necessary to detect or calculate the input time with a frequency higher than 1 Hz.

Moreover, it is preferable that setting increment/decrement control circuit 105 operates in response to each clock signal having a frequency of 4, 8 or 16 Hz, which is generated by the frequency divider circuit 101. In this case, the reasons why the clock signal having the frequency of 4, 8 or 16 Hz is used for the timing of an operation of the setting increment/decrement control circuit 105 are as follows. First, if a clock signal having a frequency equal to or lower than 2 Hz is used, an operator does not feel that the forwarding is performed at a fast rate and thus the operator is irritated. Conversely, if a clock signal having a frequency equal to or higher than 32 Hz is used, the load imposed on the software for the addition or subtraction processing increases so that the possibility of making it difficult to complete the processing within an operation cycle is increased.

Furthermore, the setting increment and decrement to be used by setting increment/decrement control circuit 105 is initially set as ±1 unit time. Then, it is preferable that after a lapse of a predetermined period, the increment and decrement are changed to $\pm 2^n$ (±2, ±4, ±8, . . . ) units of time. Thereby, even in the case where the value of one of places or digits (for instance, a one-minute place or digit), which is used for setting a time, is increased or decreased discontinuously (for example, ±2, ±4 or ±8), the value of each place having an order higher than the time setting place (namely, the one-minute place) is continuously increased or decreased differently from the time setting place. This does not give a visual impression that the setting increment or decrement is discontinuous. Thus this has an advantage in that good operability is provided to an operator. Namely, in the case where a time is set in a state in which the increment or decrement is ±1, ±2 or ±4 minutes, the value of the one-minute place is displayed at a regular time interval (for example, every (¼), (⅛) or (1/16) seconds) regardless of the value of the time to be set. Further, in the case where a time is set in a state in which the increment or decrement is ±2, ±4 or ±8 minutes, the numerical value of each of the places or digits having an order higher than the time setting place, for instance, the numerical value of a ten-minutes place or digit is increased or decreased one by one. Moreover, the rate of changing the value of the ten-minutes place is gradually increased even if the display of the value of the time setting place or digit is discontinuous. Thus an operator does not get a feeling of visual incongruity. The amount of change caused by the addition or subtraction (namely, the increment or decrement), which is used in this case, is twice that used in the aforementioned case and is constant, so that it is easy for an operator to know the rate of change and predict the amount of change. Consequently, the time can be set precisely and easily.

Figure 3:
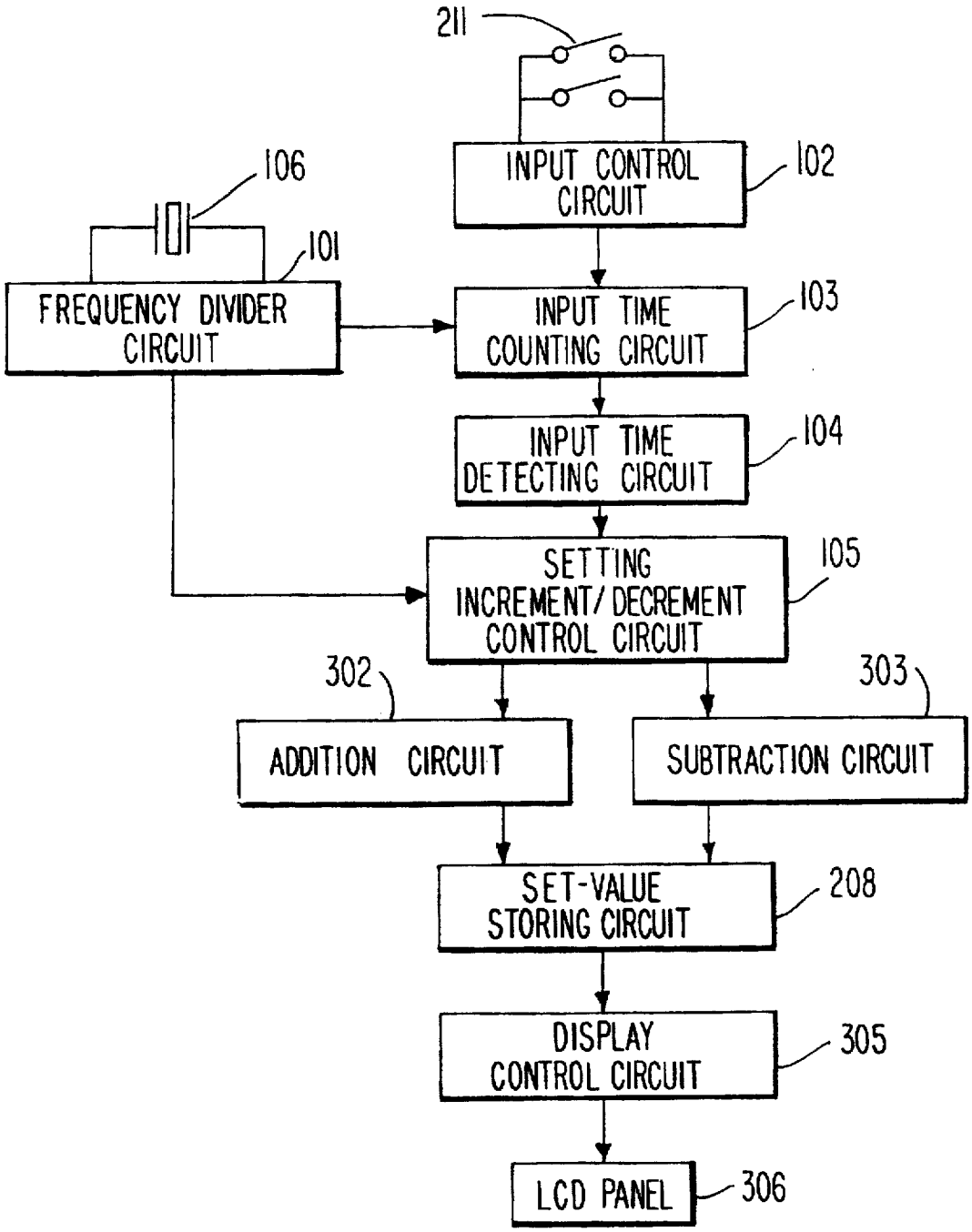
FIG. 3 is a more detailed block diagram of an electronic clock constructed in accordance with a first embodiment of the present invention.

Next, reference is made to FIG. 3 wherein a more detailed block diagram of an electronic clock constructed in accordance with a first embodiment of the present invention is provided. The difference in this drawing being the addition of addition circuit 302 and subtraction circuit 303 each receiving inputs from setting increment/decrement control circuit 105 and providing outputs to a set value storing circuit 208. A display control circuit which receives an output from set value storing circuit 208 provides an output to LCD panel 306.

Input control circuit 102 detects the input state of each of two switches 211 respectively used for an addition and a subtraction is connected to input time counting circuit 103. Further, input time counting circuit 103 counts or measures a period of time corresponding to the duration a signal continuously inputted from a single one of time switches 211 is detected, based on an output clock signal of the frequency divider circuit 101. Moreover, input time counting circuit 103 is connected to the input time detecting circuit 104 which detects that a value obtained by input time counting circuit 103 reaches a predetermined value. The input time detecting circuit 104 is connected to a setting increment/decrement control circuit 105. Increment/decrement control circuit 105 is operative to change the increment or decrement of the set value of a unit of time, which is added thereto or subtracted therefrom every period in response to an output clock signal of frequency divider circuit 101, according to an output of input time detecting circuit 104. An addition circuit 302 and a subtraction circuit 303 receive as inputs, signals from setting increment/decrement control circuit 105 and perform an addition and a subtraction, respectively, on a value stored in a set-value storing circuit 208 (corresponding to set-value storing memory 8 of FIG. 2) according to an output of setting increment/decrement control circuit 105. When the addition circuit 302 or addition switch is operated, an addition is performed. In contrast, when the subtracting circuit or subtraction switch is operated, a subtraction is performed. The contents of set-value storing circuit 208 are displayed on an LCD panel 306 through a display control circuit 305.

Figure 4:
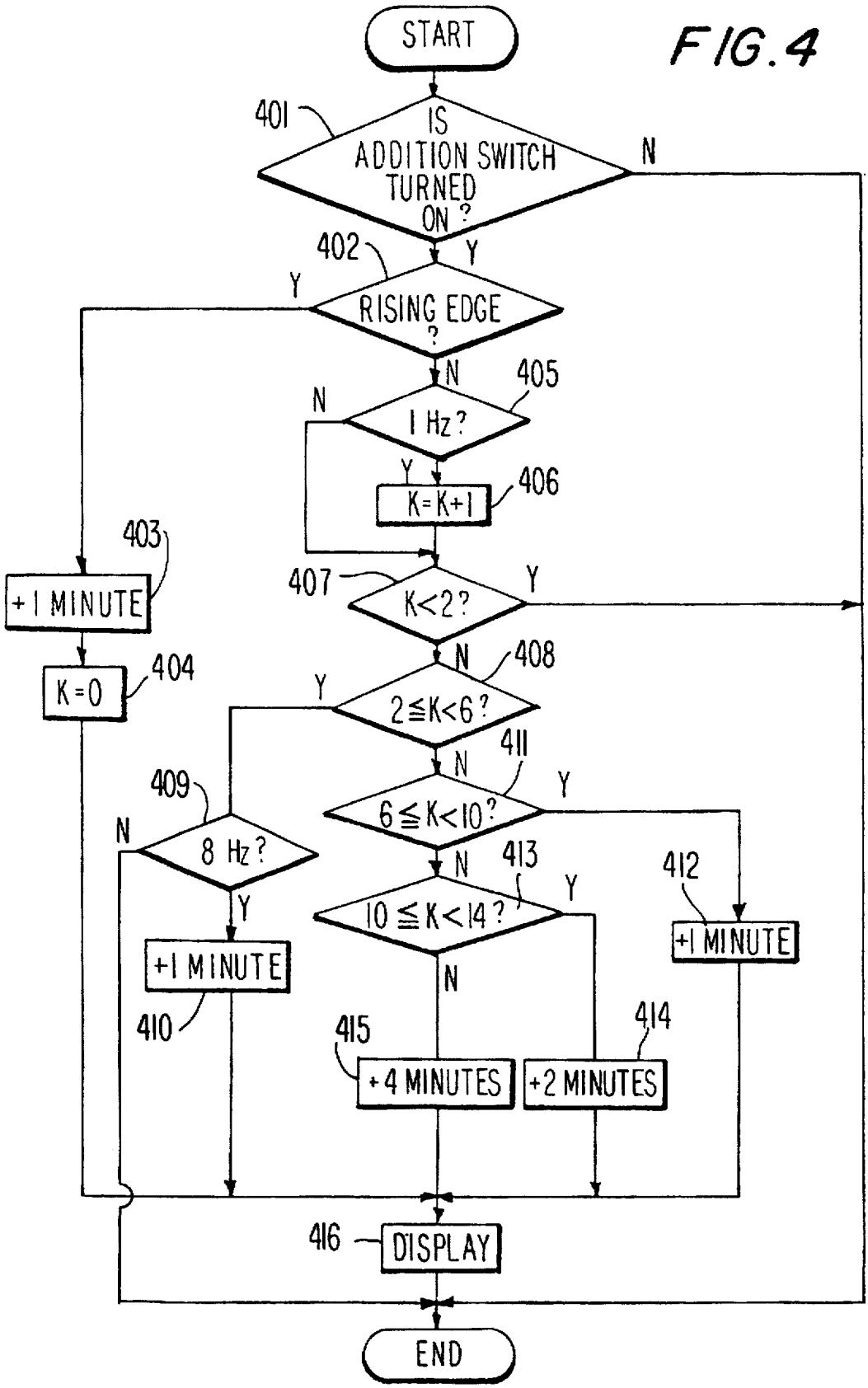
FIG. 4 is a flowchart of a program used in the electronic clock in accordance with the first embodiment of the present invention.
Figure 5A:
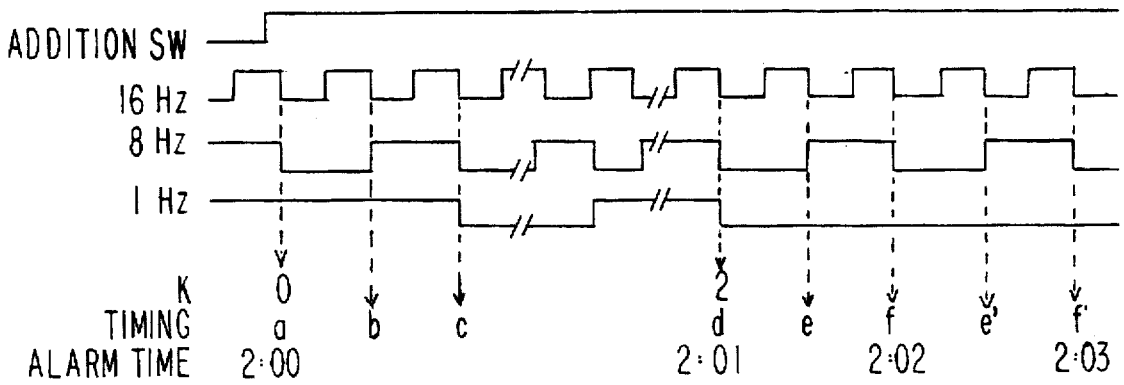
FIGS. 5(*a*) to 5(*d*) are timing charts of the electronic clock in accordance with the first embodiment of the present invention.
Figure 5B:
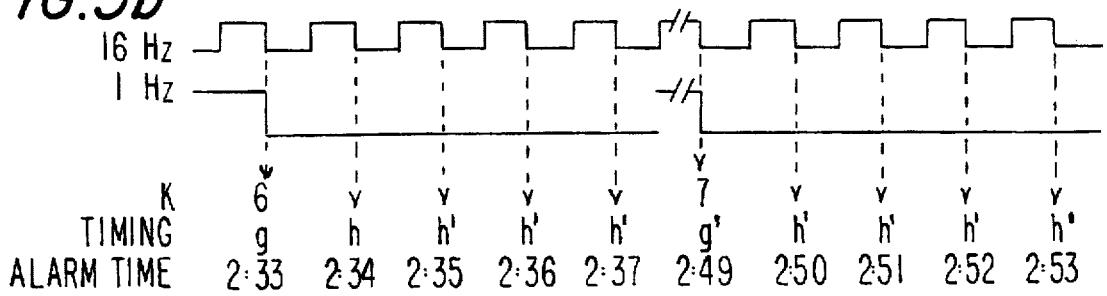
Figure 5C:
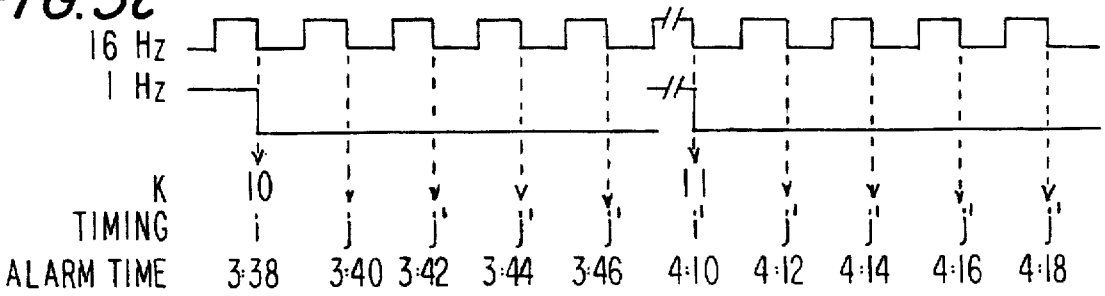
Figure 5D:
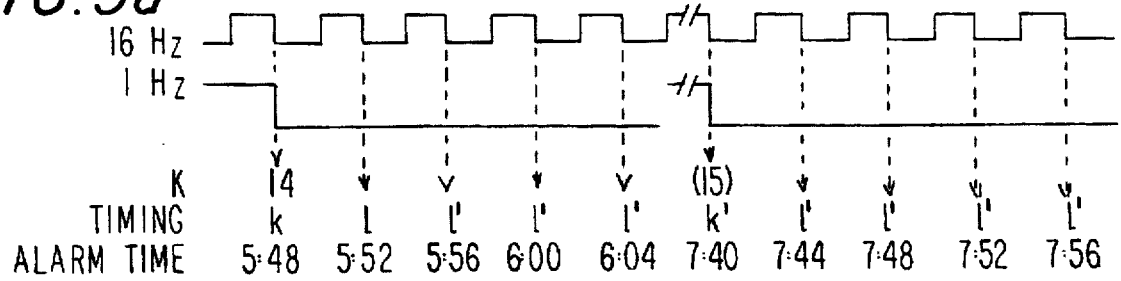

The operation illustrated in the block diagram of FIG. 3 will also be described by referring to the flowchart of FIG. 4 and the timing chart of FIG. 5. In the following description, only an operation thereof when performing an addition will be described. An operation in which a subtraction is performed is similar to the addition operation. Therefore, a description of a subtraction operation is omitted herein.

It is assumed that frequency divider circuit 101 is adapted to operate on a falling edge of the clock signal and that interruption control circuit 204 is adapted to generate an interruption in synchronization with a falling edge of a clock signal having a frequency of 1 or 16 Hz, the frequencies produced by frequency divider circuit 101. Further, it is assumed that a set value for setting a time represents an alarm time of the hours-and-minutes setting type, that when the addition switch is turned on, 1 minute is added to a current set value of time at a point in time corresponding to the rising edge of a clock signal, that after it is detected that a signal is continuously inputted for a period of 1 to 2 seconds, 1 minute is added thereto every time an interval corresponding to the clock frequency of 8 Hz while the signal is continuously inputted, that 1 minute is added thereto every time an interval corresponding to the clock frequency of 16 Hz for the next period of 4 seconds, that 2 minutes are added thereto every time an interval corresponding to the clock frequency of 16 Hz elapses for the subsequent period of 4 seconds and that thereafter, 4 minutes are added thereto every time an interval corresponding to the clock frequency of 16 Hz elapses.

In the case where an interruption occurs in synchronization with the falling edge of an internal clock signal having a frequency of 16 or 1 Hz and an alarm can be set, a program which can be stored in ROM 6 (FIG. 2) and illustrated by the flowchart of FIG. 4, runs. In the state in which an alarm can set, this program runs every interval corresponding to the clock frequency of 16 Hz. Further, it is assumed that initially an alarm time is set as 1:59 and the addition switch is not turned on. Reference is also made to FIGS. 5(*a*)–5(*d*).

First, it is detected in step 401 whether or not the addition switch is turned on. If in an initial state, the addition switch is not turned on the program finishes running. In contrast, when the program starts running after the addition switch is turned on (at a timing moment a), (FIG. 5(*a*)), it is first detected in step 401 whether or not the addition switch is turned on. If it is detected that the addition switch is turned on, in step 402 it is determined whether or not an input signal is on a rising edge. Since, in this example, the input signal is on a rising edge, 1 minute is added to the currently set alarm time (1:59) in step 403, so that the alarm time is changed to 2:00. Then a K-value, calculated by input time counting circuit 103, for counting an input time during which the input signal is continuously input, is reset to 0 (step 404). Predetermined kinds of information are then displayed in step 416 and thereafter, the program finishes running.

Where the program starts running in response to the next interruption caused after a lapse of a time interval corresponding to the clock frequency of 16 Hz (at a timing moment b of FIG. 5(*a*)), similarly, it is first detected in step 401 whether or not the addition switch is turned on. Since, as shown in FIG. 5(*a*), the addition switch is turned on, it is determined (step 402) whether or not the input signal is on a rising edge. At this moment in this example, the input signal is not on a rising edge. Thus, step 405 is executed to determine whether or not a 16-Hz interruption to be caused every period corresponding to the clock frequency of 16 Hz and an 8-Hz interruption to be caused every period corresponding to the clock frequency of 1 Hz occur simultaneously. In this case, a 1-Hz interruption to be caused every period corresponding to the clock frequency of 1 Hz does not occur at the timing moment b of FIG. 5(*a*). Thus, it is next determined in step 407 whether or not the K-value is less than 2. At the timing moment b, the K-value is 0. Therefore, the program finishes running.

In the case where the program starts running in response to the next interruption caused after a lapse of a time interval corresponding to the clock frequency of 16 Hz (at a timing moment c of FIG. 5(*a*)), it is first determined (step 401) whether or not the addition switch is turned on. Since the switch is on, it is next determined in step 402 whether or not the input signal is on a rising edge. Since, in this example, the input signal is not on a rising edge, it is next determined in step 405 whether or not a 1-Hz interruption occurs. In this case, the 1-Hz interruption occurs at the timing moment c. Thus, 1 is added to the current K-value (K=0) in step 406, so that the K-value is increased to 1. It is then determined in step 407 whether or not the K-value is less than 2. At timing moment c, the K-value is 1, and the program finishes running.

Thereafter, an operation similar to that performed at the timing moment b of FIG. 5(*a*) is repeatedly performed 15 times. At the timing moment d, the detection of the turning-on of the addition switch (step 401), the detection of a rising edge of the input signal (step 402) and the detection of an occurrence of a 1 Hz interruption (step 405) are performed. At timing moment d, it is clear that a 1-Hz interruption occurred. Thus, 1 is added to the current K-value in step 406 and the K-value is increased to 2. Next, it is determined in step 407 whether or not the K-value is less than 2. As described above, since the K-value is 2 at the timing moment d, it is determined whether or not the K-value is equal to or greater than 2 and less than 6 in step 408. Because the K-value is 2, the program advances to step 409 whereupon the contents of frequency divider circuit 101 are read and it is determined whether or not the signal level of a clock signal having a frequency of 8 Hz is a low (L) level. At this moment, the level of this 8-Hz signal is a low level. Thus, 1 minute is added to the current alarm time and the alarm time is changed to 2:01 in step 410. Information is then displayed in step 416. Thereafter, the program finishes running.

Similarly, at the next timing moment e, the detection of the turning-on of the addition switch (step 401), the detection of a rising edge of the input signal (step 402) and the detection of an occurrence of a 1-Hz interruption (step 405) are performed. At this timing moment e, since there is no 1-Hz interruption, it is then determined (step 407) whether or not the K-value is less than 2. The K-value is 2 at the timing moment e. Therefore, it is next determined in step 408 whether or not the K-value is equal to or greater than 2 and less than 6. Because the K-value is 2 at this moment, the program advances to step 409. However, in this case, the level of the 8-Hz signal is a high (H) level. Thus, the program finishes running.

At the timing moment f, the detection of the turning-on of the addition switch (step 401), the detection of a rising edge of the input signal (step 402) and the detection of an occurrence of a 1-Hz interruption (step 405) are performed. At timing moment f, there is no 1-Hz interruption and it is determined in step 407 whether or not the K-value is less than 2. The K-value is 2 at the timing moment f. Therefore, it is determined next in step 408 whether or not the K-value is equal to or greater than 2 and less than 6. Because the K-value is 2 at this moment, the program advances to step 409. Similarly as at timing moment d, the level of the 8-Hz signal is an L-level. Thus, 1 minute is added to the current alarm time (step 410). Consequently, the alarm time is changed to 2:02 in step 410. Information is then displayed in step 416. Subsequently, the program finishes running.

Thereafter, in a period in which the K-value is equal to or greater than 2 and less than 6, the operations respectively performed at timing moments d, e and f are repeatedly performed according to whether or not a 16-Hz interruption and a 1-Hz interruption occur. Therefore, during a period of 4 seconds in which the K-value is equal to or greater than 2 and less than 6, 1 minute is added to the current alarm time every period corresponding to the clock frequency of 8 Hz. That is, 8 minutes are added to the alarm time in a period of 1 second. Each time the alarm time is changed, the display of the alarm time is updated. Thus, a total of 33 minutes, which includes 1 minute added when turning on the switch, are added to the initially set alarm time 1:59. Consequently, the alarm time reaches 2:32.

The judgement on the signal level of the 8-Hz signal is performed in step 409 of FIG. 4 by reading the 8-Hz signal generated by the frequency divider circuit, although other methods may be used for such a judgment. This program also runs every time interval corresponding to the clock frequency of 16 Hz. Thus, the program may be modified in such a manner that a binary counting operation is performed on the 16-Hz signal so that when the resultant count is 0, 1 minute is added to the alarm time in step 410 but when the resultant count is 1, such an addition is not performed and the program finishes running.

FIG. 5(*b*) is a timing chart for illustrating an operation in the example where the K-value has reached 6 (as a result of repeating the aforementioned operations of FIG. 5(*a*)) and during the time when the K-value is equal to or greater than 6 and less than 10. At a timing moment g, the detection of the turning-on of the addition switch (step 401), the detection of a rising edge of the input signal (step 402) and the detection of an occurrence of a 1-Hz interruption (step 405) are performed. At this timing moment, a 1-Hz interruption occurs so 1 is added to the K-value (step 406) so that the K-value becomes 6. Step 407 determines if the K-value is less than 2. Since the K-value is 6, step 408 determines if the K-value is equal to or greater than 2 and less than 6. Because the K-value is 6, the program advances to step 411 whereupon it is determined whether or not the K-value is equal to or greater than 6 and less than 10. Therefore, step 412 is performed and 1 minute is added to the current alarm time, and the alarm time becomes 2:33. Information is then displayed in step 416. Thereafter, the program finishes running.

At a timing moment h, the detection of the turning-on of the addition switch (step 401), the detection of a rising edge of the input signal (step 402) and the detection of an occurrence of a 1-Hz interruption (step 405) are performed.

At this timing moment, a 1-Hz interruption does not occur. Thus, it is then judged in step 407 whether or not the K-value is less than 2. Moreover, it is judged next in step 408 whether or not the K-value is equal to or greater than 2 and less than 6. Because the K-value is 6 at this moment, 1 minute is added to the current alarm time. Thus, the alarm time is changed to 2:34 in step 412. Information is then displayed in step 416. Subsequently, the program finishes running.

Thereafter, in a period in which the K-value is equal to or greater than 6 and less than 10, the operations respectively performed at the moments g and h are repeatedly performed according to whether or not a 16-Hz interruption and a 1-Hz interruption occur. Therefore, during a period of 4 seconds in which the K-value is equal to or greater than 6 and less than 10, 1 minute is added to the current alarm time every period corresponding to the clock frequency of 16 Hz. Namely, 16 minutes are added to the alarm time in a period of 1 second. Each time the alarm time is changed, the display of the alarm time is updated. Consequently, the alarm time reaches 3:36.

FIG. 5(*c*) is a timing chart for illustrating an operation in the example where the K-value has reached 10 as a result of repeating the aforementioned operation shown in FIG. 5(*b*) and in a period of time in which the K-value is equal to or greater than 10 and less than 14.

At a timing moment i, the detection of the turning-on of the addition switch (step 401), the detection of a rising edge of the input signal (step 402) and the detection of an occurrence of a 1-Hz interruption (step 405) are performed. At timing moment i, a 1-Hz interruption occurs. Thus, 1 is added to the K-value in step 406, so that the K-value reaches 10. It is then determined in step 407 whether or not the K-value is less than 2. It is then determined in step 408 whether or not the K-value is equal to or greater than 2 and less than 6. Then, it is determined in step 411 whether or not the K-value is equal to or greater than 6 and less than 10. As described above, since the K-value is 10 at this moment, the program advances to step 413 whereupon it is determined whether or not the K-value is equal to or greater than 10 and less than 14. Because the K-value is 10, 2 minutes are added to the current alarm time, and the alarm time is changed to 3:38 in step 414. Information is then displayed in step 416. Thereafter, the program finishes running.

At a timing moment j, the detection of the turning-on of the addition switch (step 401), the detection of a rising edge of the input signal (step 402) and the detection of an occurrence of a 1-Hz (step 405) are performed. At this timing moment, a 1-Hz interruption does not occur. Thus, it is then determined in step 407 whether or not the K-value is less than 2. It is then determined in step 408 whether or not the K-value is equal to or greater than 2 and less than 6. Then it is determined in step 411 whether or not the K-value is equal to or greater than 6 and less than 10. Thereafter, it is determined in step 413 whether or not the K-value is equal to or greater than 10 and less than 14. Because the K-value is still 10 at this moment, 2 minutes are added to the current alarm time and the alarm time is changed to 3:40 in step 415. Information is then displayed in step 416. Subsequently, the program finishes running.

Thereafter, in a period in which the K-value is equal to or greater than 10 and less than 14, the operations respectively performed at the moments i and j are repeatedly performed according to whether or not a 16-Hz interruption and a 1-Hz interruption occur. Therefore, during a period of 4 seconds in which the K-value is equal to or greater than 10 and less than 14, 2 minutes are added to the current alarm time every period corresponding to the clock frequency of 16 Hz. Namely, 32 minutes are added to the alarm time in a period of 1 second. Each time the alarm time is changed, the display of the alarm time is updated. Consequently, the alarm time reaches 5:44. In this case, the effects of the additions are substantially equivalent to those obtained by performing the addition every period corresponding to the clock frequency of 32 Hz. However, in this embodiment, the addition and the displaying are performed every time interval corresponding to the clock frequency of 16 Hz.

FIG. 5(*d*) is a timing chart illustrating an operation in the example where the K-value has reached 14 as a result of repeating the aforementioned operation of FIG. 5(*c*) and in a period of time in which the K-value is equal to or greater than 14.

At a timing moment k, the detection of the turning-on of the addition switch (step 401), the detection of a rising edge of the input signal (step 402) and the detection of an occurrence of a 1-Hz (step 405) are performed. At this timing moment, a 1-Hz occurs. Thus, 1 is added to the K-value in step 406, so that the K-value reaches 14. It is then determined in step 407 whether or not the K-value is less than 2, whether the K-value is equal to or greater than 2 and less than 6 in step 408 and whether the K-value is equal to or greater than 6 and less than 10 in step 411. Then, as described above, since the K-value is 14, 4 minutes are added to the current alarm time and the alarm time is increased to 5:48 (step 415). Then, information is displayed in step 416. Thereafter, the program finishes running.

At a timing moment l, the detection of the turning-on of the addition switch (step 401), the detection of a rising edge of the input signal (step 402) and the detection of an occurrence of a 1-Hz interruption (step 405) are performed. At this timing moment, a 1-Hz interruption does not occur. Thus, it is then determined whether the K-value is less than 2 (step 407), whether the K-value is equal to or greater than 2 and less than 6 (step 408), whether the K-value is equal to or greater than 6 and less than 10 (step 411) and whether the K-value is equal to or greater than 10 and less than 14 (step 413). Because the K-value is 14 at this moment, 4 minutes are again added to the current alarm time so that the alarm time is changed to 5:52 in step 414. Information is then displayed in step 416. Subsequently, the program finishes running.

Thereafter, in a period in which the K-value is equal to or greater than 14, the operations respectively performed at the moments k and l are repeatedly performed according to whether or not a 16-Hz interruption and a 1-Hz interruption occur. Therefore, during a period of 4 seconds in which the K-value is equal to or greater than 14, 4 minutes are added to the current alarm time every period corresponding to the clock frequency of 16 Hz. Namely, 64 minutes are added to the alarm time in a period of 1 second. Each time the alarm time is changed, the display of the alarm time is updated. In this case, the effects of the additions are substantially equivalent to those obtained by performing the addition every period corresponding to the clock frequency of 64 Hz. However, in this embodiment, the addition and the displaying are performed every time interval corresponding to the clock frequency of 16 Hz, similarly.

Figure 6:
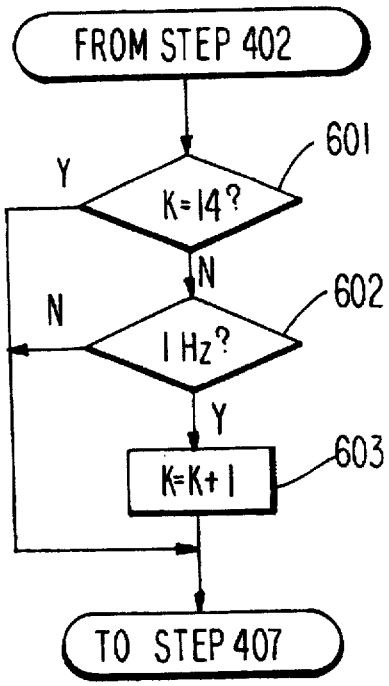
FIG. 6 is a flowchart of operation of the electronic clock in accordance with the first embodiment of the invention during operation of a switch for a longer duration.

After the K-value reaches 14, the operations respectively performed at the moments k and l are repeated. Thus, as illustrated in FIG. 6, it is not necessary to accumulate the K-value, so that if after step 402 is performed, it is determined that K does not equal 14 in step 601. In step 602, it is determined whether a 1 Hz interruption has occurred and, if so, K is incremented by 1 in step 603 prior to returning to step 407.

In the first embodiment, the set increment is not more than 4 minutes. Of course, the increment may be more than such a value or rate. For example, 8, 10, 16, 20, 30 or 60 minutes may be employed as the increment. Moreover, other various patterns of variation in increment may be employed. For an example of one such modification, the initial increment may be set as 1 minute, but the increments are changed to 2 minutes, 5 minutes and 10 minutes in this order thereafter.

However, among such variations, it is preferable that the increment changes by $2^n$ times the current value thereof, namely, the increment changes from 1 to 2, and 4 to 8. This is because an operator can easily infer how the increment will change and also can set a time without anxiety and will reduce the possibility that a user will have a feeling of incongruity, since the changing rate of the increment is always a factor of 2 and therefore, predictable and constant. In addition, although the value held at the time-setting place (namely, the one-minute place, in this case) changes discontinuously, the values held at places (namely, the ten-minutes place and the one-hour place and so forth), whose order is higher than the order of the time-setting place, vary continuously. Thus an operator has a feeling of smoothness (that is, there is no feeling of incongruity).

Moreover, in this embodiment, the fast-forward rate is not so large when the K-value for counting the period of time is relatively small during which the input signal is continuously inputted from the switch. This is because it is supposed that there is a case where a time being relatively close to a preliminarily set alarm time is set. That is, in the case where a time being relatively close to a preliminarily set time is set as an alarm time, a fine adjustment of time is started immediately after the switch is turned on. In such a case, if the fast forward is performed at a high rate from the beginning, a displayed set time may immediately exceed (i.e., pass) the alarm time to be set.

In contrast, in this embodiment, the increment varies. Therefore, this embodiment is effective even where a time being relatively far away from a preliminarily set time is set as an alarm time. That is, in this embodiment, all points in time from a time being relatively close to a preliminarily set time and to another time being relatively far away from the preliminarily set time can be set as the alarm time quickly and accurately.

Next, a second embodiment of the present invention will be described. In the case of this second embodiment, a time-setting place is changed from the first embodiment in which the increment or decrement itself of the value of time set at the time setting place is varied. Thereby, the increment or decrement is substantially changed during a fast forward.

Figure 7:
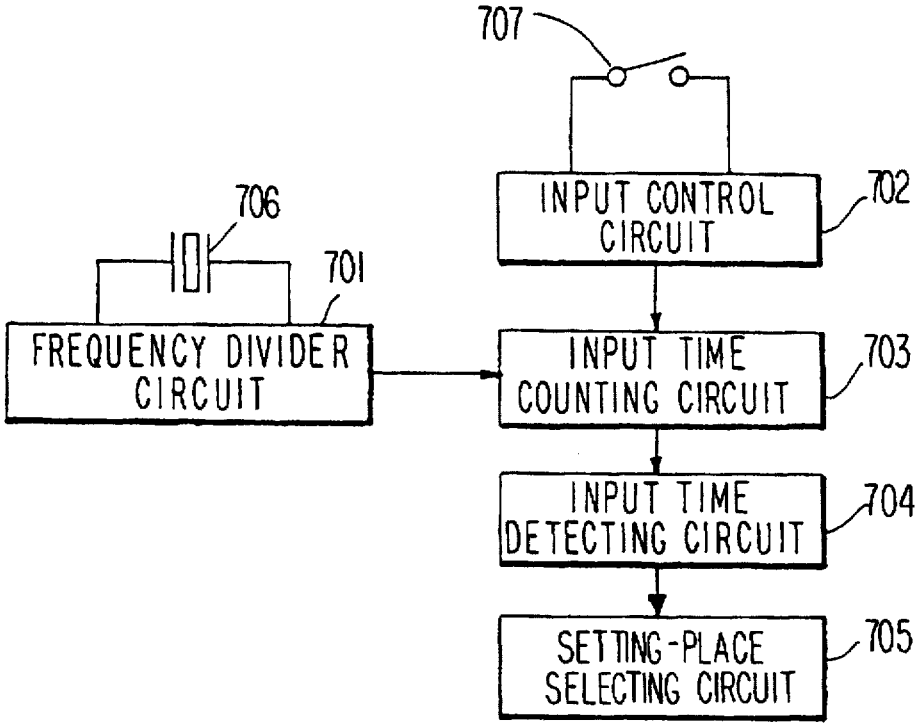
FIG. 7 is a block diagram of an electronic clock constructed in accordance with a second embodiment of the present invention.

Reference is now made to FIG. 7, wherein a block diagram of an electronic clock constructed in accordance with a second embodiment of the present invention is shown. This electronic clock includes a frequency divider circuit 701 for "dividing down" the frequency of a source oscillator 706 such as a crystal oscillator. An input control circuit 702 detects a switch input (signal) inputted by operating a switch 707 for setting a time. An input time counting circuit 703 counts or measures a period of time during which input control circuit 702 detects a continuous input signal sent from the same switch by using output clock signals of frequency divider circuit 701. An input time detecting circuit 704 detects the fact that the period measured by input time counting circuit 703 reaches a predetermined value, and a setting-place selecting circuit 705 for selecting a setting place according to an output of input time detecting circuit 704.

In this embodiment of the electronic clock, a time setting place, at which a time is set, is changed differently from the first configuration of the electronic clock in which the increment or decrement itself of the value of time set at the time setting place is varied. Thereby, the increment or decrement is substantially changed.

Figure 8:
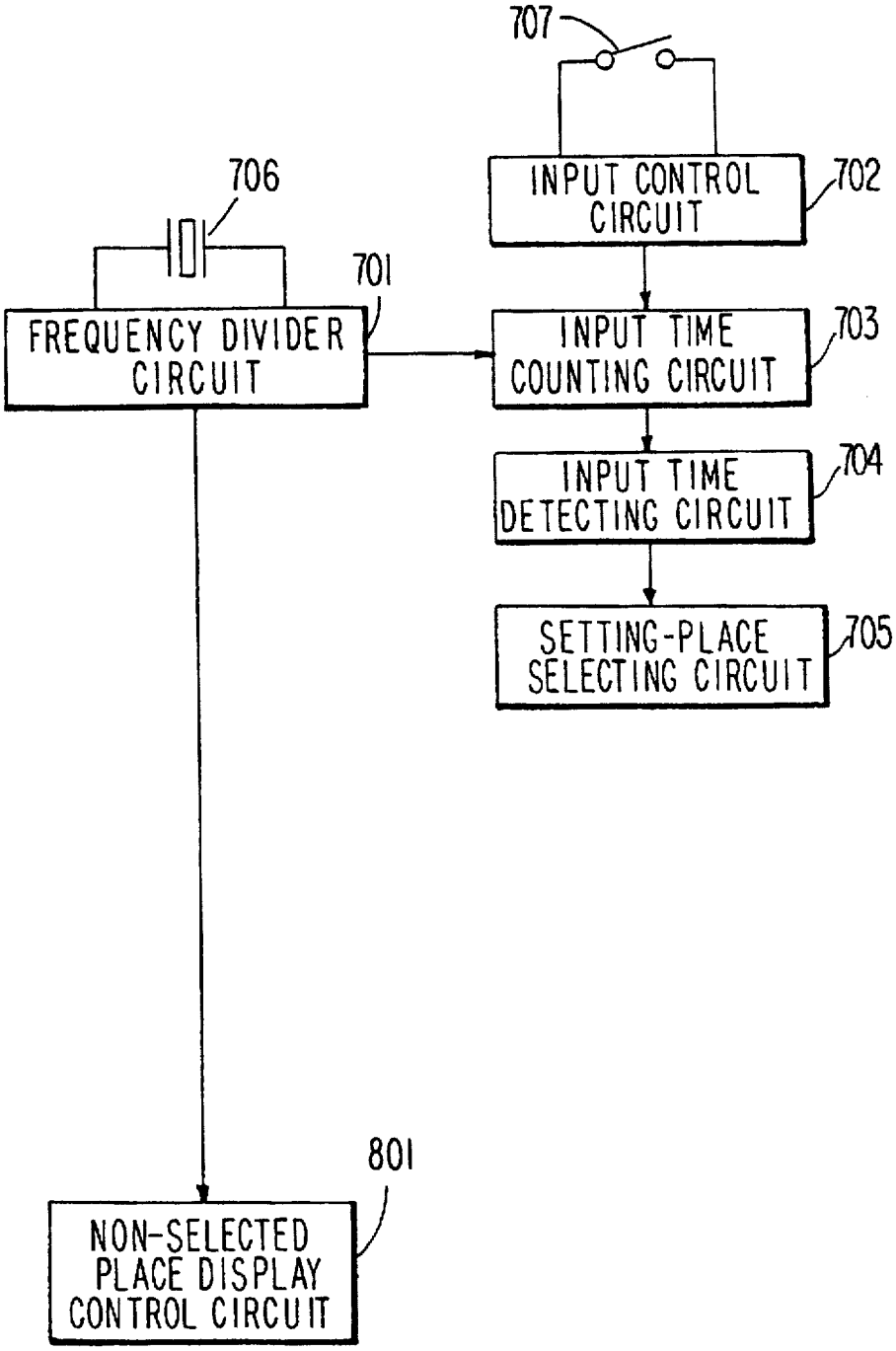
FIG. 8 is a block diagram of an electronic clock constructed in accordance with a third embodiment of the present invention.

Reference is now made to FIG. 8 wherein a third embodiment of the invention is provided. Like numerals are utilized to indicate like structures, the primary difference being the use of a non-selected place display control circuit 801 for displaying given numerical values, symbols, characters and patterns provided in the electronic clock corresponding to the places or digits other than a numerical-value place selected by the setting-place selecting circuit 705. Thereby, this electronic clock has an advantage in that an operator does not get a feeling of incongruity even if the values respectively held at the non-selected places (for instance, the places whose orders are lower than the order of the selected setting-place). Moreover, the display at each non-selected setting-place may be controlled in such a manner as to be turned on or off.

Furthermore, it is preferable that the non-selected setting-place display control circuit 801 operates at a speed faster than the operating speed of addition/subtraction circuit and display control circuit which are caused by setting-place selecting circuit 705 to operate. Thereby, this electronic clock has advantages in that it can be known at a glance how the time is set and that an operator can smoothly perform an operation without getting a feeling of incongruity.

Figure 9:
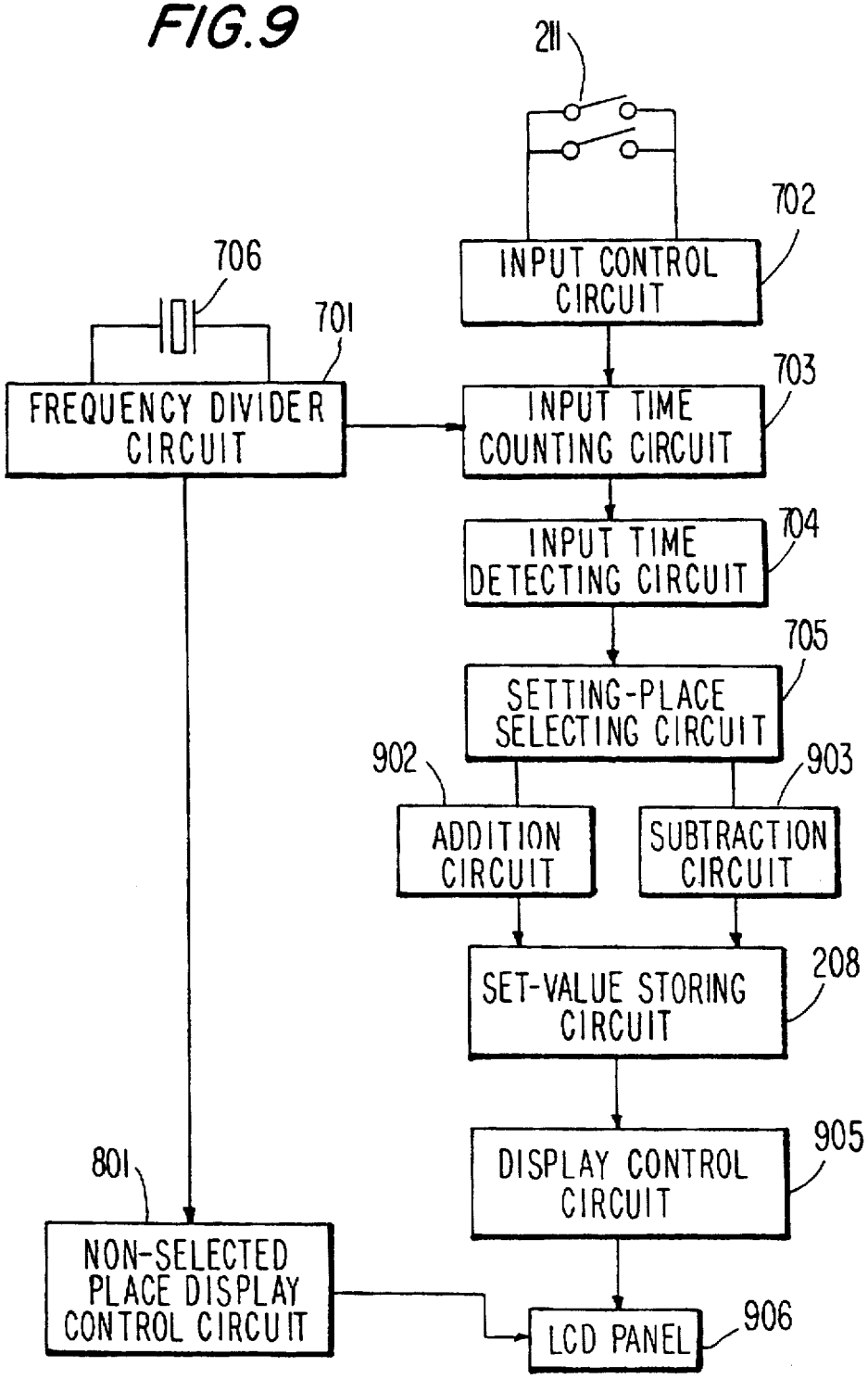
FIG. 9 is a more detailed block diagram of an electronic clock constructed in accordance with a third embodiment of the present invention.

Reference is now made to FIG. 9 wherein a more detailed block diagram of the second embodiment of the electronic clock in accordance with the present invention is provided. Like numerals are utilized to identify like structures, the primary difference being the addition of addition circuit 902, subtraction circuit 905, set valve storing circuit 208 and LCD display panel 906.

In FIG. 9, an input control circuit 702 for detecting a turned-on state of switch 211 is connected to an input time counting circuit 703. The input time counting circuit 703 is connected to a frequency divider circuit 701 and is operative to count a period of time, corresponding to the duration an input signal input from a single switch is detected, in response to an output signal of the frequency divider circuit 701. Moreover, input time counting circuit 703 is connected to an input time detecting circuit 704 and is operative to detect when the count value obtained by input time counting circuit 703 reaches a predetermined value. These composing elements are similar in function and design as their corresponding elements of the first embodiment.

Input time detecting circuit 704 is connected to a setting-place selecting circuit 705 which changes the setting place, at which the time is set, according to a value outputted from input time detecting circuit 704. An addition circuit 902 and a subtraction circuit 903 are connected to setting-place selecting circuit 705 and perform an addition operation or a subtraction operation, respectively, according to an output of setting-place selecting circuit 705 on a value stored in set-value storing circuit 208. Among the contents of set-value storing circuit 208 are values respectively held at places, whose orders are higher than the order of the selected place, and which are displayed on an LCD panel 906 through a display control circuit 905. Further, values respectively held at places, whose orders are lower than the order of the selected place, are displayed on the LCD panel 906 through a non-selected place display control circuit 801.

Hereinafter, an operation of the electronic clock having the configuration as illustrated in the block diagram of FIG.

9 will be described by referring to flowcharts of FIGS. 10 and 11. In the following description, only an operation thereof when performing an addition will be described, although it is to be understood that when performing a subtraction, a similar operation thereto is performed. Thus, the description of an operation when performing a subtraction is omitted herein.

It is assumed that frequency divider circuit 701 is designed to operate on a falling edge of a clock signal and that the interruption control circuit 4 of FIG. 2 is adapted to generate an interruption in synchronization with a falling edge of a clock signal having a frequency of 1 or 16 Hz, which is produced by frequency divider circuit 701. Further, it is assumed that a set value for setting a time represents an alarm time of the hours-and-minutes setting type, that when the addition switch is turned on, 1 minute is added to a current set value of time at a time corresponding to the rising edge of a clock signal, that after it is detected that a signal is continuously inputted for a period of 1 to 2 seconds, 1 is added to the value held at the one-minute place every time interval corresponding to the clock frequency of 8 Hz during 4 seconds in which the signal is continuously inputted, that 1 is added to the value held at the tens-minutes place every time interval corresponding to the clock frequency of 8 Hz for the next period of 4 seconds, that 1 is added to the value held at the ten-hours place every time interval corresponding to the clock frequency of 8 Hz for the subsequent period of 4 seconds, and that thereafter, 1 is added to the value held at the ten-hours place every time interval corresponding to the clock frequency of 8 Hz. It is understood that an alarm time of a type other than the hours-and-minutes setting type may be used. For example, an alarm time of each of the hours-minutes-seconds setting type, the years-months-days setting type and the months-days-hours-minutes type may be employed.

Figure 10:
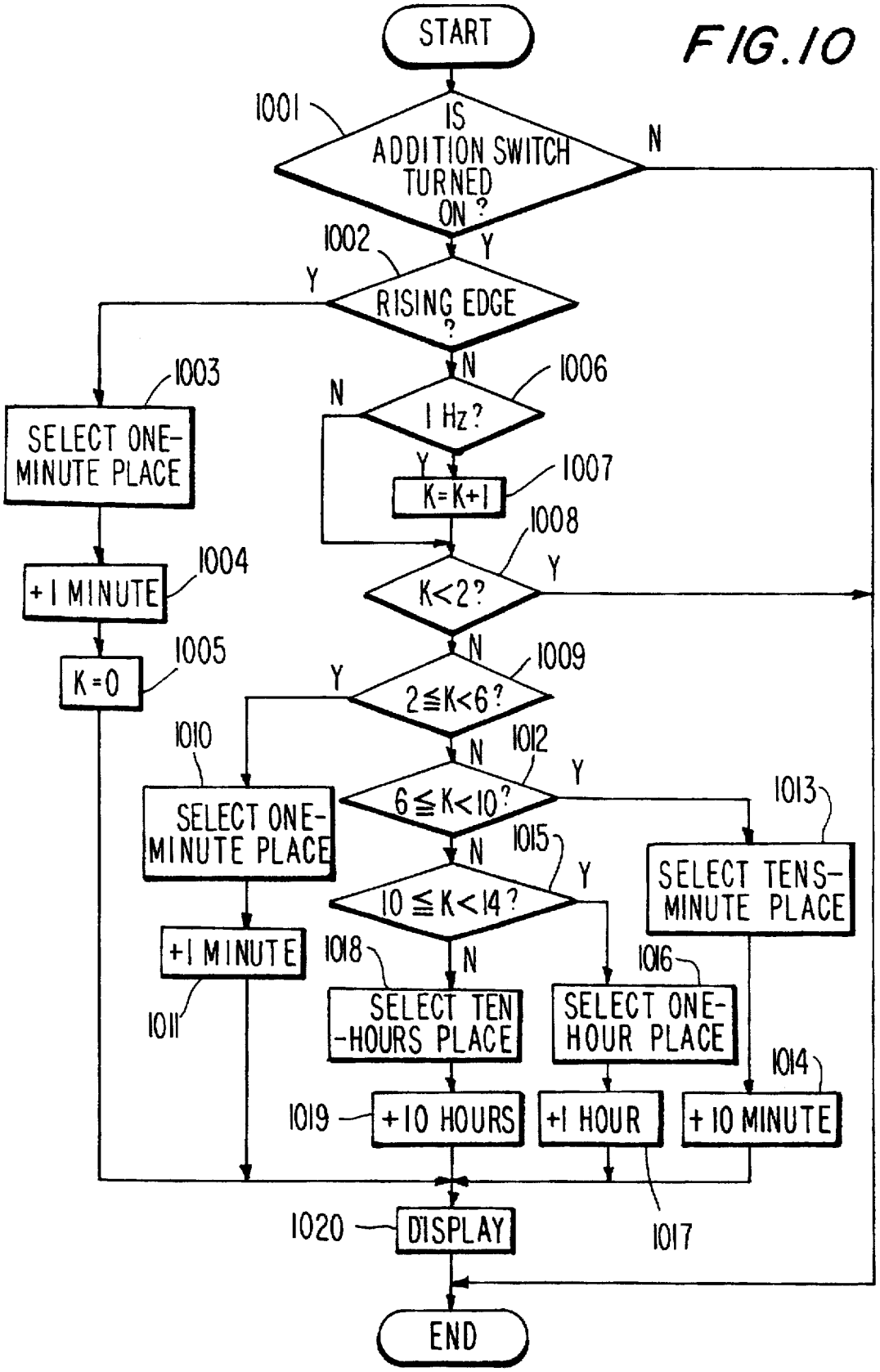
FIG. 10 is a flowchart of the operation of the electronic clock in accordance with the third embodiment of the present invention.

In the case where an interruption occurs in synchronization with the falling edge of an internal clock signal having a frequency of 8 or 1 Hz and an alarm can be set, a program illustrated by a flowchart of FIG. 10, which is stored in ROM 6 of FIG. 2, runs. In the state in which an alarm can be set, this program runs every time interval corresponding to the clock frequency of 8 Hz.

First, it is detected in step 1001 whether the addition switch is turned on. If the addition switch is not turned on, this program finishes running. Where this program starts running after the addition switch is turned on and it is determined in step 1001 that the addition switch is turned on, it is then determined in step 1002 whether or not there is a rising edge of the input signal. If the input signal is at a rising edge, the one-minute place is selected in step 1003 and 1 (minute) is then added to the currently set alarm time in step 1004. Subsequently, a K-value for counting an input time, during which the input signal is continuously inputted, is reset to 0 in step 1005. Predetermined kinds of information are then displayed in step 1020. Thereafter, the program finishes running.

In the case where the input signal is not at a rising edge, it is determined in step 1006 whether or not a 1-Hz interruption and an 8-Hz interruption simultaneously occur. If a 1-Hz interruption occurs, 1 is added to the current K-value in step 1007. If no 1-Hz interruptions occur, such an addition is not performed. It is then determined in step 1008 whether or not the K-value is less than 2. If less than 2, the program finishes running. If the K-value is not less than 2, it is determined in step 1009 whether or not the K-value is equal to or greater than 2 and less than 6. If equal to or greater than 2 and less than 6, the one-minute place is selected in step 1010 as the setting place at which the time is set. Further, 1 minute is added to the currently set alarm time in step 1011. Predetermined kinds of information are then displayed in step 1020.

If the K-value is equal to or greater than 6 and less than 10 (step 1009), the ten-minutes place is selected in step 1013 as the setting place. Then, 10 minutes are added to the currently set alarm time in step 1014. Thereafter, predetermined kinds of information are displayed (step 1020).

If the K-value is equal to or greater than 10 and less than 14 as determined in step 1015, the one-hour place is selected in step 1016 as the setting place. Then, 1 hour is added to the currently set alarm time in step 1017. Subsequently, the predetermined kinds of information are displayed (step 1020).

If the K-value is not less than 14, the tens-hours place is selected in step 1018 as the setting place. Then, 10 hours are added to the currently set alarm time in step 1019. The predetermined kinds of information are then displayed (step 1020). It has been found that when setting an alarm time, it is rare that the K-value becomes equal to or larger than 14. Thus, this routine is hardly used.

It will now be briefly described how the alarm time changes performed in accordance with the program illustrated in the flowchart of this figure are executed. It is premised that the initial alarm time is 1:59 and that an operator continues to operate the addition switch in order to set a new alarm time. It will be described in Table 1 listed below how the alarm time changes in this case.

TABLE 1

| | |
|---|---|
| Initial alarm time | 1:59 |
| When operating addition switch (K = 0) | 2:00 |
| When first 1-Hz interruption occurs | 2:00 |
| (K = 1. This moment is reference time S) | |
| 1 second after S (K = 2) | 2:01 |
| 2 seconds after S (K = 3) | 2:09 |
| 3 seconds after S (K = 4) | 2:17 |
| 5 seconds after S (K = 6) | 2:33 |
| 6 seconds after S (K = 7) | 3:53 |
| 7 seconds after S (K = 8) | 5:13 |
| 9 seconds after S (K = 10) | 7:53 |
| 10 seconds after S (K = 11) | 15:53 |
| 11 seconds after S (K = 12) | 23:53 |

As can be seen from this table, this embodiment is advantageous where a time being relatively close to the preliminarily set initial time is set as the alarm time and where a time being relatively far away from the preliminarily set initial time is set as the alarm time. Further, in this embodiment, the selected setting-place is shifted in sequence depending upon the period of time during which the switch is continuously operated. Thus, this embodiment is very convenient where an operator wishes to set a date in addition to minutes and seconds simultaneously by operating only one switch.

In step 1020 of the flowchart of FIG. 10, it is preferable that among places or digits used to represent the alarm time, the places whose orders are equal to or higher than the order of the selected setting place, namely, the places holding values which may be changed are used to represent such values and in contrast, the places having orders lower than the order of the selected setting place are operated to blink or are turned off or are used to indicate arbitrary numerical values, symbols, characters and characters. This is because there cannot be a change in numerical value at the places whose orders are less than the order of the selected place. This is because places once selected as the setting place are not selected again, in this embodiment, as long as the switch is continuously operated. Therefore, it is preferable in view of the operability of this embodiment for an operator that the manner of the display represented at each of the places having orders lower than the order of the selected setting-place is made to be different from that of the display represented at the places having orders equal to or higher than the order of the selected setting-place.

Further, in step 1020 of the aforementioned program, numerical values or the like are simultaneously displayed at all of the places or digits. However, numerical values or the like may be displayed at the places having orders equal to or higher than the order of the selected setting-place at a frequency different from the frequency at which numerical values are displayed at the places having orders lower than the order of the selected setting-place.

Figure 11:
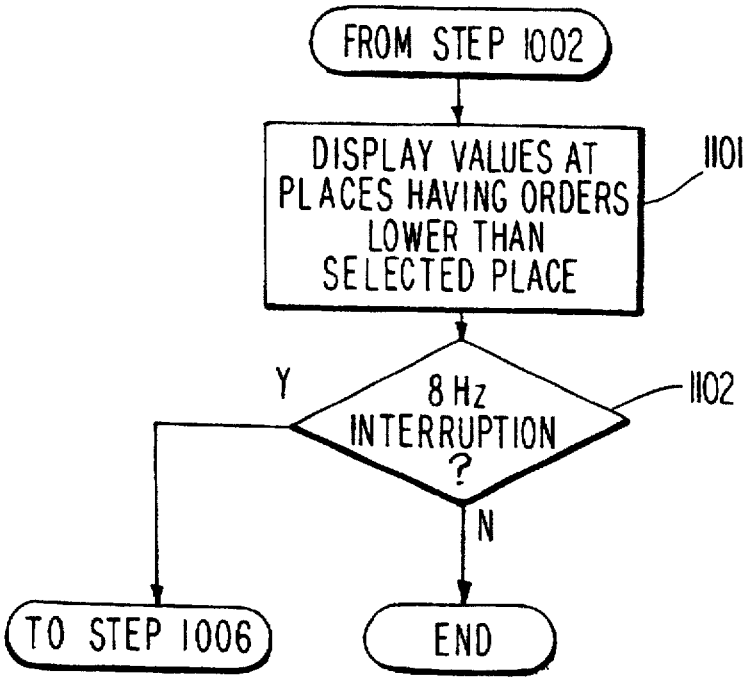
FIG. 11 is a supplemental flowchart of the operation of the electronic clock in accordance with the third embodiment of the present invention.

FIG. 11 is a flowchart of a program used to treat the display represented at each of the places, the orders of which are equal to or higher than the order of the selected setting-place, in a manner different from the manner in which the display represented at each of the places, the orders of which are lower than the order of the selected setting-place, and used to display numerical values or the like at the places having orders equal to or higher than the order of the selected setting-place at a frequency different from the frequency at which numerical values are displayed at the places having orders lower than the order of the selected setting-place. In this case, the program illustrated in the flowchart of FIG. 10 is adapted to run in response to 1-Hz interruptions and 32-Hz interruptions. That is, this program is executed at a frequency being four times the frequency at which the program previously described is executed. As shown in FIG. 11, numerical values or the like are displayed in step 1101 at the places having orders lower than the order of the selected setting-place, subsequently to the processing of step 1002 of the flowchart of FIG. 10. Next, an 8-Hz signal is read out. If the 8-Hz signal has an L-level (low level), the program returns to step 1006 in order to perform the addition processing. Conversely, if the 8-Hz signal has a H-level (High level), the program only finishes running.

In accordance with this method, the display represented at each of the places having orders lower than the order of the selected setting-place comes to vary every period corresponding to the clock frequency of 32 Hz. However, the display represented at each of the places having orders being equal to or higher than the order of the selected setting-place comes to vary every period corresponding to the clock frequency of 8 Hz. Thus, an operator can easily distinguish the selected setting-place from the other places owing to the fact that the manner of the display represented at each of the places having orders being equal to or higher than the order of the selected setting-place is different from the manner of the display represented at each of the places having orders being lower than the order of the selected setting-place. Moreover, because the frequency of change of the display at each of the places having orders being lower than the order of the selected setting-place is 32 Hz and is thus high, an operator can not know and need not mind what is displayed at each of these places. Consequently, an operator can concentrate his attention on an operation of setting values at each of the places having orders being equal to or higher than the order of the selected setting-place.

Further, although the manner of the display represented at each of the places having orders lower than the order of the selected setting-place is made to be different from that of the display represented at the places having orders equal to or higher than the order of the selected setting-place in the case of this embodiment, the display at the places other than the selected setting-place may be controlled similarly as in the case of the display at each of the places having orders lower than the order of the selected setting-place. Thereby, an operator can concentrate his attention on an operation of setting a value at the selected setting-place. Incidentally, a carry may occur at the selected setting place. Therefore, it is preferable that at least the manner of the display represented at each of the selected setting-place and the place, whose order is higher than the order of the selected setting-place by one, is made to be different from the manner of the display represented at each of the places, whose orders are lower than the order of the selected setting-place.

Moreover, this embodiment may be constructed in such a manner that when the selected setting-place is changed, the alarm sounding circuit is used to inform an operator of the change of the selected setting-place. In this embodiment, the alarm sounding circuit sounds every 4 seconds. This further improves the reliability and operability of the electronic clock of the present invention.

In this embodiment, the interruption processing is performed in response to each 16-Hz clock signal or each 8-Hz clock signal. The interruption processing, however, may be performed in response to clock signals, each of which has a frequency other than 8 and 16 Hz. As long as the timing of interruptions is performed in such a manner that an operator can feel the smoothness of the fast forward and the time can be set accurately and quickly, there is no limitation to be imposed on the frequencies of clock signals. Preferably, clock signals having frequencies of 4 to 16 Hz are used. If the frequency of interruptions is too low, the fast forward rate or speed becomes low. Thus it takes a lot of time to set the time. Moreover, if the frequency of interruptions is too high, the rate or speed of change in numerical value displayed at each place or digit becomes too high. This increases the possibility of preventing an operator from accurately setting the time. It is, however, necessary to take into account the software processing time required to perform the additions or subtractions. Furthermore, if the frequency of interruptions is too high, a load imposed on software becomes very large. Therefore, notice that there is a fear that the necessary processing can not be completed within a cycle of the interruption and thus the fast forward can not be achieved at a stable speed.

Furthermore, in this embodiment, the increment is added to or the decrement is subtracted from the currently set time for the purpose of achieving the fast forward by using the two switches. The fast forward, however, may be performed by using either the addition switch or the subtraction switch. Namely, the time is set by performing only the additions (or the subtractions). Incidentally, in this case, an operator needs to pay attention to the operation to avoid having the currently set time exceed a target alarm time. However, in the case of the electronic clock of the present invention, an operator does not have a feeling of incongruity. Therefore, an operator's error will rarely occur when setting a time in the electronic clock, in comparison with the conventional method for setting a time in a conventional electronic clock.

Additionally, the time setting method is applied to an alarm time. However, the application of the method of the present invention is not limited thereto. The time setting method of the present invention may be used to set, for example, a time indicated by a fundamental clock (a current time, a local time at each place of the world, or the like) and a preselected time (an activating time/a stopping time of an electronic equipment interlinked with an electronic clock, for instance, a time preprogrammed in a timer, a time preprogrammed for sound/picture recording, or the like) other than an alarm time.

The time setting method of the present invention can be applied to any electronic clock as long as a time is set therein by performing a fast forward. Especially, in the case of the electronic clock of the present invention, the power consumption thereof is small and the configuration thereof is very simple. Therefore, the present invention can be applied most preferably to portable electronic clocks such as a wristwatch and a pocket watch, which are driven by a battery and require a small-sized electronic circuit.

It will thus be seen that the objects set forth above, among those made apparent from the preceding description, are efficiently attained and, since certain changes may be made in carrying out the above method and in the construction set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An electronic timepiece for indicating a time, comprising:

a source oscillator having a predetermined frequency;

a frequency divider circuit, operatively coupled to said source oscillator, dividing down said frequency of said source oscillator to a clock signal;

an input device generating a continuous input signal when actuated;

an input control circuit, operatively coupled to said input device, detecting said input signal from said input device;

an input time counting circuit, operatively coupled to said input control circuit and said frequency divider circuit, utilizing said clock signal to measure a predetermined period of time while the input control circuit detects a continuous input signal from said input device;

an input time detecting circuit, operatively coupled to said input time counting circuit, and counting the number of said measured predetermined periods of time; and a setting increment/decrement control circuit, operatively coupled to said input time detecting circuit for incrementing or decrementing a set time by a set value in response to each count of said input time detecting circuit, said setting increment/decrement control circuit varying said set value at selected counts of said input time detecting circuit.

2. The electronic clock as claimed in claim 1, wherein the setting increment and decrement used by the setting increment/decrement control circuit is initially set as ±1 unit of time and wherein after a predetermined count, the setting increment or decrement is changed to $\pm 2^n$ units of time, wherein n is an integer equal to or greater than 1.

3. The electronic clock as claimed in claim 1, wherein said frequency divider outputs a plurality of clock signals of different frequencies, and the input time counting circuit counts said clock signals, each of said clock signals counted by said input time counting circuit having a first frequency and the setting increment/decrement control circuit changing the value of a unit of time to be added and subtracted in response to clock signals having a second frequency and third frequency.

4. The electronic clock as claimed in claim 3, wherein said first frequency is essentially equal to 1 Hz, said second frequency is essentially equal to 8 Hz and said third frequency is essentially equal to 16 Hz.

5. The electronic clock as claimed in claim 1, further including an addition circuit and a subtraction circuit, each being operatively coupled to said setting increment/decrement control circuit, and a set value storing circuit operatively coupled to said addition circuit and said subtraction circuit, said set value storing circuit storing a set value of time and said addition and said subtraction circuits performing one of an addition and subtraction operation, respectively, on said set value of time stored in said set value storing circuit in response to an output signal of said setting increment/decrement control circuit.

6. The electronic clock as claimed in claim 5, further including a display operatively coupled to said set value storing circuit, said display displaying said time stored in said set value storing circuit.

7. An electronic clock, comprising:

a source oscillator having a predetermined frequency;

a frequency divider circuit, operatively coupled to said source oscillator, and dividing down said frequency of said source oscillator to a clock signal;

an input device generating a continuous input signal when actuated;

an input control circuit, operatively coupled to said input device, and detecting said input signal from said input device;

an input time counting circuit, operatively coupled to said frequency divider circuit and said input control circuit, and counting a period of time from said clock signal during which the input control circuit detects a continuous input signal from said input device;

an input time detecting circuit, operatively coupled to said input time counting circuit, and detecting when said period of time counted by the input time counting circuit equals a predetermined value; and a setting-place selecting circuit, operatively coupled to said input time detecting circuit, and selecting a time-setting-place at which a time is set in accordance with an output of the input time detecting circuit.

8. The electronic clock as claimed in claim 7, further including a non-selected place display control circuit operatively coupled to said frequency divider circuit displaying an arbitrary value at each place other than the time-setting-place selected by the setting-place selecting circuit.

9. The electronic clock as claimed in claim 7, including a non-selected place display control circuit operatively coupled to said frequency divider circuit displaying a value at each place other than the time-setting-place by blinking the value corresponding to the time setting place and turning off an indication of the value displayed at each of the places other than the time-setting-place, the value being selected by the setting-place selecting circuit.

10. The electronic clock as claimed in claim 8, wherein the non-selected place display control circuit operates at an operating speed faster than an operating speed of a display circuit controlled by the setting-place selecting circuit.

11. The electronic clock as claimed in claim 7, further including an addition circuit and a subtraction circuit operatively coupled to said setting increment/decrement control circuit.

12. The electronic clock as claimed in claim 11, further including a set value storing circuit operatively coupled to said addition circuit and said subtraction circuit storing a set value of time and said addition circuit and subtraction circuit performing one of addition and subtraction, respectively, on said set value in accordance with an output signal from said setting increment/decrement control circuit.

13. The electronic clock as claimed in claim 12, further including a display operatively coupled to said set value storing circuit, said display displaying said time stored in said set value storing circuit.

14. The electronic clock as claimed in claim 12, further including a non-selected place display control circuit operatively coupled to said frequency divider circuit displaying an arbitrary value at each place other than the time-setting-place selected by the setting-place selecting circuit, a display operatively coupled to said set value storing circuit and said non-selected place display control circuit, said display displaying said time stored in said set value storing circuit.

15. A method for setting a time in an electronic timepiece having an input, comprising the steps of:

generating a clock signal having a predetermined frequency;

detecting an input signal which is continuous for the duration of desired time setting once said input signal has been actuated;

counting the number of uniform predetermined periods of time during which said input signal is continuously applied, by using said clock signal to produce a counted value of the number of said predetermined periods of time;

changing the time set in said timepiece by a set value every predetermined period of time during which said input signal is continuously inputted; and varying the set value at selected predetermined periods of time during which said input signal is continuously inputted in accordance with the counted value of the predetermined periods of time.

16. The method for setting a time in an electronic clock, as claimed in claim 15, further including the step of setting one of an increment and decrement of a unit of time as ±1 unit of time and changing one of said increment and decrement of said unit of time by $\pm 2^n$ units of time at a predetermined count, wherein n is an integer equal to or greater than 1.

17. The method for setting a time in an electronic clock, as claimed in claim 15, wherein the step of counting a period of time, during which said input signal is continuously inputted, comprises the steps of:

using divided down clock signals having a frequency of 1 Hz to change its set time; and calculating the set value of the unit of time in response to divided down clock signals each having a frequency of one of 8 Hz and 16 Hz.

18. The method for setting a time in an electronic clock, as claimed in claim 15, further including the step of selecting a time-setting-place at which a time is set wherein the set value of the unit of time is varied every predetermined constant period.

19. The method for setting a time in an electronic clock, as claimed in claim 18, further including the step of displaying an arbitrary value at each place other than the selected time-setting-place.

20. The method for setting a time in an electronic clock, as claimed in claim 18, further including one of the steps of blinking and turning off a displayed value at each place other than the selected time-setting-place.

21. The method for setting a time in an electronic clock, as claimed in claim 18, further including the step of displaying a value at each place other than the selected time-setting-place at a speed faster than a displaying speed at which a value is displayed at the selected time-setting-place.

22. The electronic timepiece of claim 1, wherein said setting increment/decrement control circuit varies said set value of every count of said input time detecting circuit.

* * * * *